US005890519A

United States Patent [19]

De Jager et al.

[11] Patent Number: 5,890,519

[45] Date of Patent: Apr. 6, 1999

[54] APPARATUS FOR CONTROLLING A WARP TENSIONER OF A WEAVING MACHINE

[75] Inventors: Godert De Jager, Volketswil; Frank Lehnert, Rüti, both of Switzerland

[73] Assignee: Sulzer Rueti AG, Rueti, Switzerland

[21] Appl. No.: 947,400

[22] Filed: Oct. 8, 1997

[30] Foreign Application Priority Data

Nov. 12, 1996 [EP] European Pat. Off. ..... 96810773

[51] Int. Cl.[6] ..... D03D 49/12

[52] U.S. Cl. ..... 139/110; 139/115; 242/154

[58] Field of Search ..... 139/115, 114, 139/110; 242/154, 155 R; 226/118.2, 195, 180, 189; 29/DIG. 42

[56] References Cited

U.S. PATENT DOCUMENTS

| | | | |
|---|---|---|---|
| 3,533,574 | 10/1970 | Cooper et al. | 424/154 |
| 3,706,328 | 12/1972 | Dostal | 139/110 |
| 4,607,666 | 8/1986 | Zwiener et al. | 139/115 |
| 5,743,307 | 4/1998 | Derudder et al. | 139/110 |

FOREIGN PATENT DOCUMENTS

| | | |
|---|---|---|
| 3532798A1 | 4/1986 | Germany . |
| 3833685A1 | 4/1990 | Germany . |
| 9304801 | 7/1993 | Germany . |

*Primary Examiner*—Andy Falik

*Attorney, Agent, or Firm*—Townsend and Townsend and Crew LLP

[57] ABSTRACT

An apparatus for controlling a warp tensioner of a weaving machine. The apparatus contains a spring member that is in working connection with the warp tensioner and a control system that has a container communicating via a 2/2 way valve with the spring member in order to vary the spring stiffness of the spring member and the position of the warp tensioner from a terminal at the side where the weaver stands by increasing and decreasing the effective volume of the spring member.

17 Claims, 7 Drawing Sheets

A
5
7
8
11
1
4
21
3
38
6
15
14
23
37
31
32
25
22
24
2
9
36
35
34
33

1
38
14
11
3

APPARATUS FOR CONTROLLING A WARP TENSIONER OF A WEAVING MACHINE

BACKGROUND OF THE INVENTION

1. Field of the Invention

The present invention relates to an apparatus for controlling a warp tensioner and to a weaving machine with such an apparatus 2. Description of the Prior Art It is known that every weaving machine is provided with a warp tensioner. The warp tensioner has a tensioner beam which is always held in the same central position. The warp tensioner performs the following tasks, among others:

Compensation of the warp thread length during the formation of the shed, and

Production of the warp tensile force and thus of the warp tension via the tensioner beam.

It is also known that the warp tension is dependent on the type of cloth.

An apparatus of the initially named kind is known from DE-U-93 04 801.7. In this apparatus the pivotally journalled tensioner beam is monitored by means of a position sensor and subjected to a bias force by an air spring. A control valve is associated with the air spring in order to vary the tension in the warp through a variation of the air pressure, with the warp tension being proportional to the change of the air pressure. The air spring has a predetermined spring characteristic and can thus only be used within limits. This applies even if the warp tensioner is subject to a bias tension by means of coil springs or torsion bars.

This is a disadvantage which leads to the requirement of replacing the tensioning springs when the article is changed, which has the resultant and known disadvantages.

The invention will be explained in the following with reference to the accompanying drawings.

Shown are:

DETAILED DESCRIPTION OF THE EXEMPLARY EMBODIMENT

Figure 1:
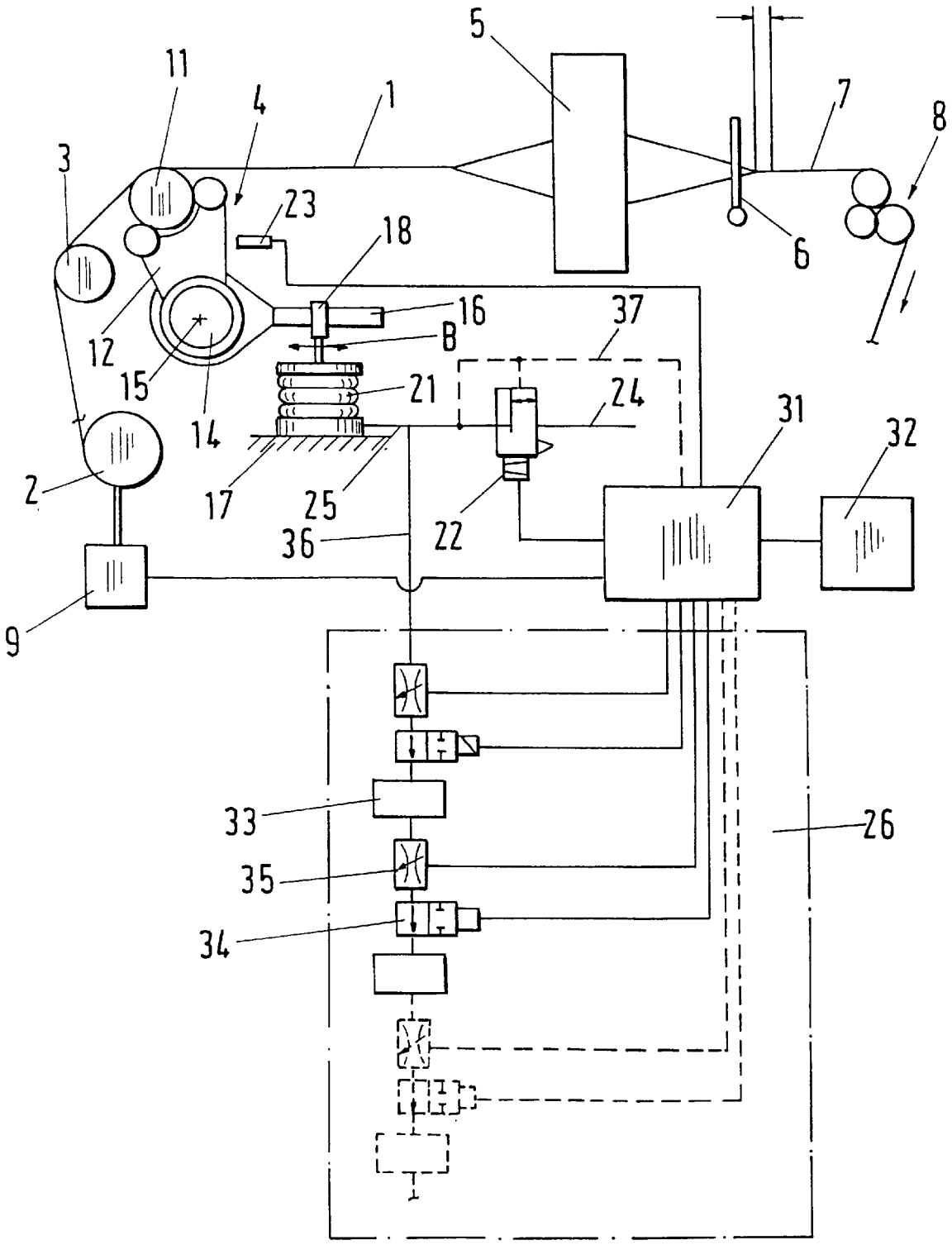
FIG. 1 is a schematic illustration of a first embodiment of an apparatus in accordance with the present invention.

As shown in FIGS. 1, 2, 4 and 5, the warp 1 is guided from a warp beam 2 over a deflection beam 3 and a warp tensioner

4 as well as through the heald frames 5 and a reed 6 and the cloth 7 over a cloth take-up apparatus 8. The warp beam 2 is provided with a warp let-off apparatus 9. The warp tensioner 4 has the task of stressing the warp 1 with a tension during the weaving process. The warp tensioner 4 is executed in a lightweight construction, is multiply supported and comprises a tensioner element 11 and a support 12 on which the tensioner element is rotatably journalled. The support is held at a support beam 14 in such a manner that the tensioner element 11 can be pivoted about the axis 15.

With reference to FIG. 1, at least one lever 16 is mounted on the support beam 14 and connected to an air spring 21 which is part of a control system. The air spring 21 is braced at the one end on the weaving machine frame 17 and is connected to the lever 16 at the other end by means of a member 18 in such a manner that the air spring 21 can be adjusted in the direction of the double arrow B. The control system contains the air spring 21, an electrically actuated control valve 22 with an air discharge valve, a sensor 23 for sensing the position of the warp tensioner 4, a pressure line 24, a connection line 25 and a control system. The control system contains a control unit 31 which is executed as a part of the control system of the weaving machine (not shown), or as a separate unit, and is connected in a signal-transmitting manner to the terminal 32 of the weaving machine. The control system also contains an arrangement 26 to specify the pivotal range of the warp tensioner 4. The arrangement comprises two groups which each have a container 33 and a 2/2-way valve 34. The groups are connected in series and are connected to the connecting line 25 via a tap line 36. In order to damp the oscillations a respective restrictor 35 is associated with each group. The control valve 22 as well as the valves 34 and restrictors 35 are connected to the control unit 31 in a signal-transmitting manner.

The setting of the desired position of the warp tensioner, the specification of the pivotal range of the warp tensioner, the setting of the warp thread tension and the setting of the damping are performed at the terminal 32. The control system, which is formed by the sensor 23, the control valve 22 and the air spring 21, is activated with the setting of the desired values and the warp tensioner is placed in the central desired position through pressure loading of the air springs and control of the warp let-off and is continually held in this position by the control system. If deviations from the desired position arise which result in a deviation in the warp tension, then the signal from the position sensor or a signal from a warp force sensor is used for the control of the warp let-off apparatus or to change the air pressure of the air spring in order to reinstate the desired warp tension and the desired position of the warp tensioner. Instead of the signal from the warp force sensor it is possible to use a signal derived from the air pressure in the air spring.

It is known that the warp tension depends on the type of the cloth to be produced. Whereas a higher thread tension and a small pivotal range are required in cloths with a high weft thread density, a constant thread tension and a larger pivotal range are required for cloths with a low weft thread density. In other words, the spring stiffness of the air spring must be changed, i.e. the spring in the known warp tensioner must be replaced. This has the previously described disadvantages as a result.

In the apparatus under discussion here, one or more containers 33 are connected to the air spring 21 by the opening of one or more valves 34. In this manner the volume is increased, with the result that the spring stiffness of the air spring 21 is changed. Different spring members are thereby imitated by the control unit 31. Furthermore, a measurement line 37 is provided for the pressure in the air spring 21.

It is known that the warp thread tension is primarily changed by the formation of sheds so that periodic fluctuations in the warp thread tension arise. For heavy cloths a high warp tension is chosen and the fluctuations are taken up by the elasticity of the warp threads, whereas for light cloths a low warp tension is provided and the fluctuations are compensated by the warp tensioner.

With the previously described apparatus these fluctuations can be influenced in an advantageous manner, and indeed by the change in the spring stiffness of the air spring. The warp tensioner can thus be used for a partial compensation of the warp tension during the formation of a shed, i.e. during the formation of a shed the warp tensioner releases a part of the warp length required for opening the shed and takes it up again when the shed is closed.

Oscillations arise in operation through the elastic behavior of the warp. In order to damp these oscillations, controllable restrictor valves 35 are placed upstream of the containers 33.

Figure 2:
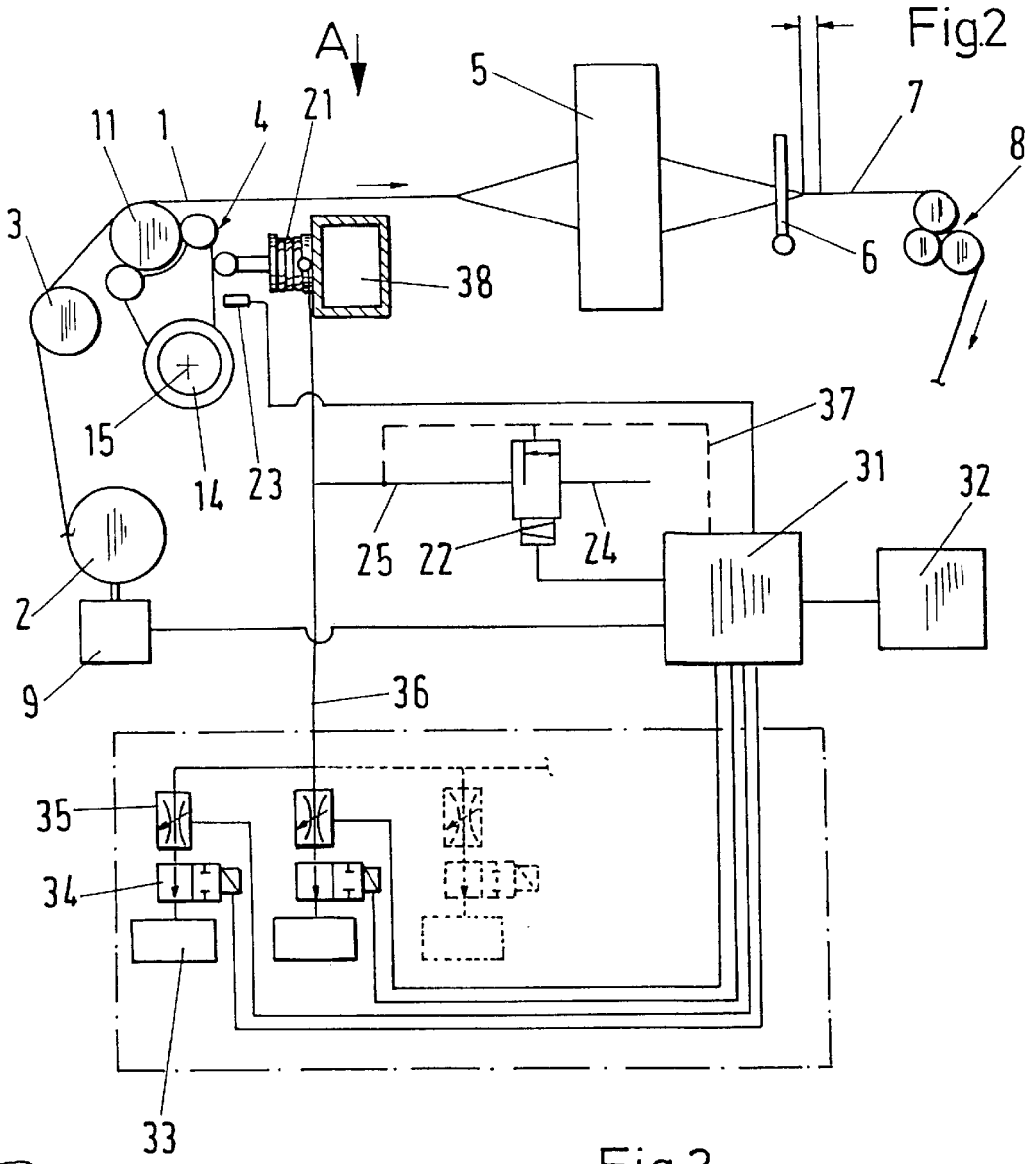
FIG. 2 is a schematic illustration of a second embodiment of an apparatus in accordance with the present invention.
Figure 3:
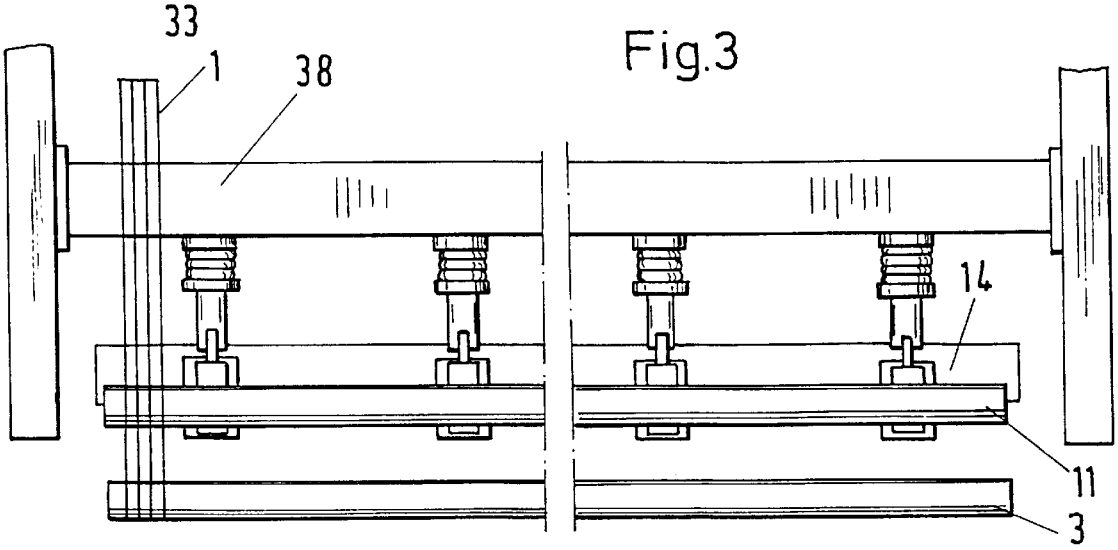
FIG. 3 is an illustration in the direction of the arrow "A" in FIG. 2.

With reference to FIGS. 2 and 3, the figures show an embodiment of the apparatus which differs from the embodiment of FIG. 1 through the arrangement of the air springs 21 and through an arrangement 27 for specifying the pivotal range of the warp tensioner 4. In this arrangement the groups, each consisting of container 33, 2/2-way valve 34 and restrictor 35, are connected in parallel and are connected to the connection line 25 via a branch line 36. As can be seen in FIG. 3, a plurality of warp tensioners 4 is provided and at least one air spring 21 is associated with each warp tensioner 4. The air springs 21 are mounted on a support 38, which is part of a weaving machine illustrated in detail in FIG. 3.

Figure 4:
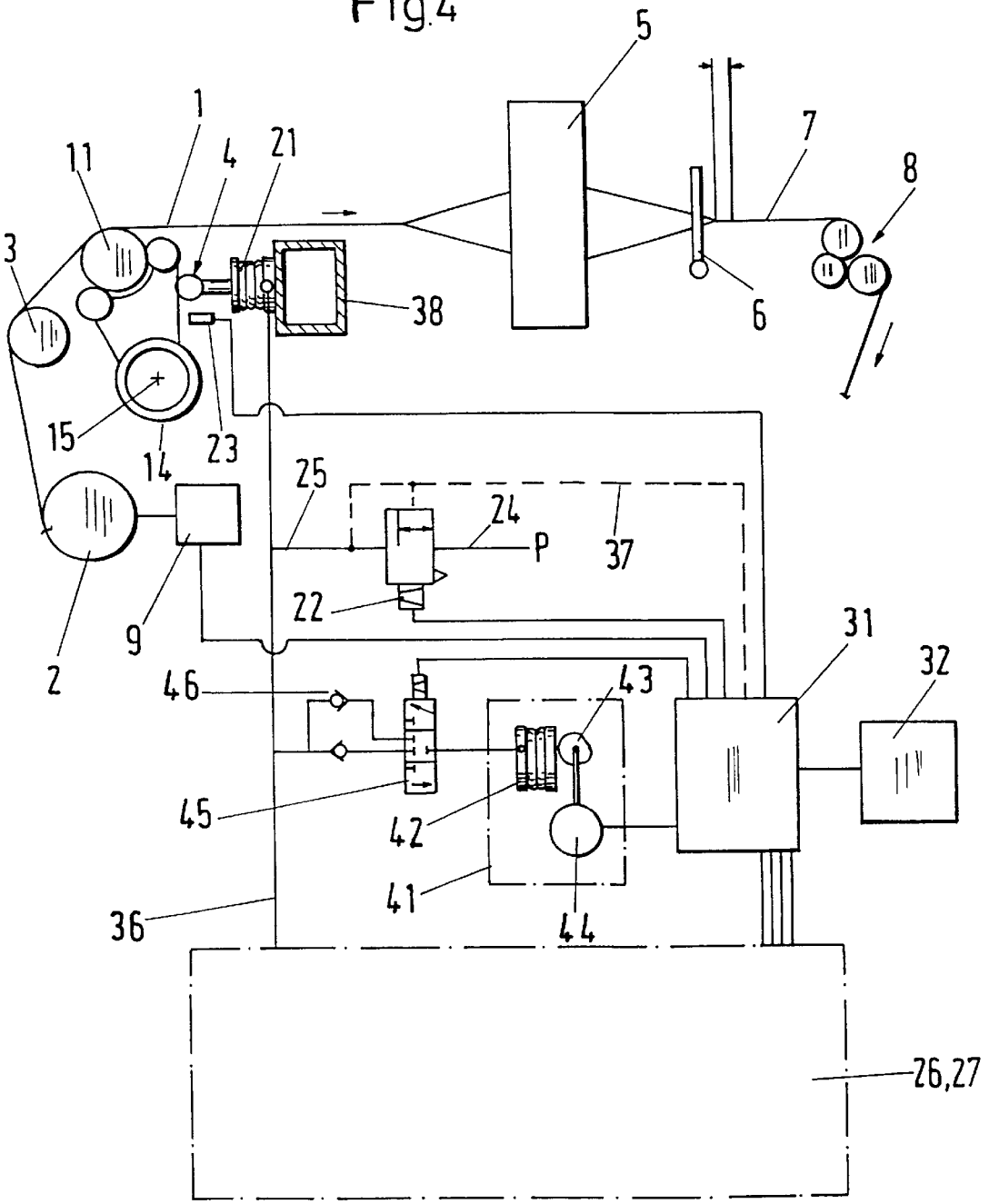
FIG. 4 is a schematic illustration of a third embodiment of an apparatus in accordance with the invention.

FIG. 4 shows an embodiment of the apparatus which is constructed in substantially the same manner as the apparatuses of FIGS. 1 and 2 and differs from the latter in that an apparatus 41 is provided in order to vary the air pressure in the air spring 21. This apparatus comprises an air spring 42 and an actuating mechanism with a cam disc 43 and an electric drive 44 which is connected to the control unit 31.

Instead of the previously described apparatus a control circuit can be used in order to periodically load the air spring 42. During this, a separate 3/3-way valve 45, which is connected to the branch line 36 via non-return valves 46, or the control valve 22 can be provided in the control system as a setting member. The warp tension is increased by means of these devices, for example at the time of the reed beat-up, whereby the weft density of the cloth is advantageously increased and is increased at the time of crossing the shed in order to improve the shed division when the shed is opened.

Figure 6:
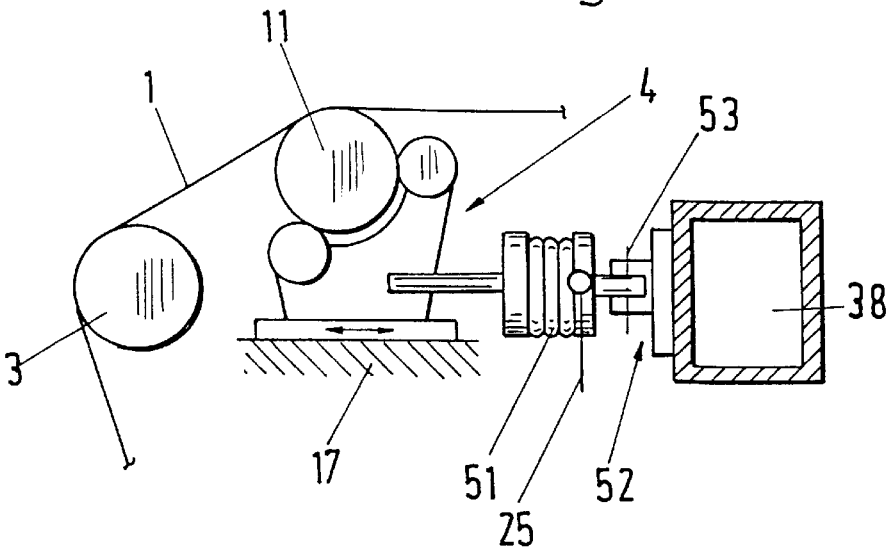
FIG. 6 is a section along the line VI—VI in FIG. 5.
Figure 5:
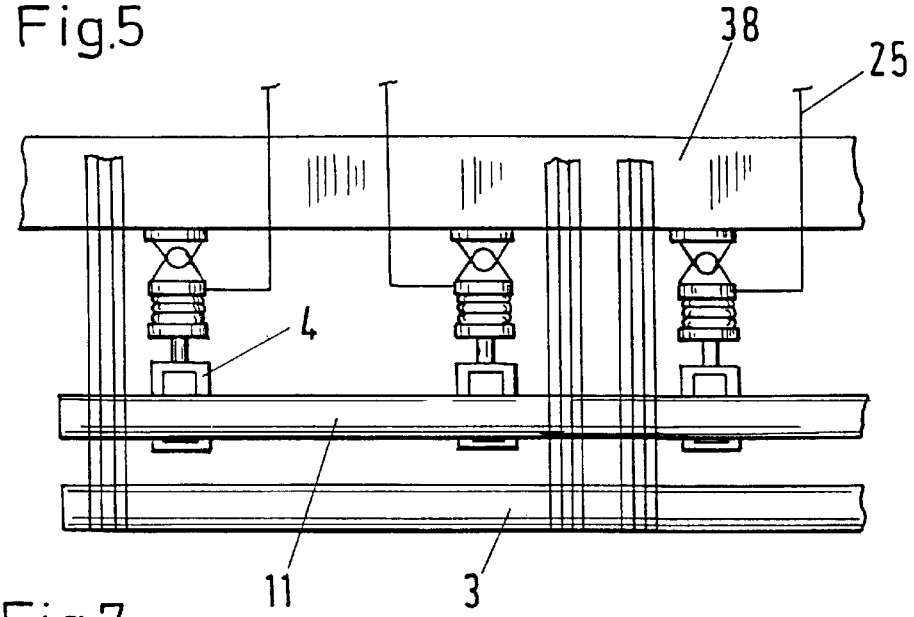
FIG. 5 is a modification of the apparatus in accordance with FIG. 3.
Figure 7:
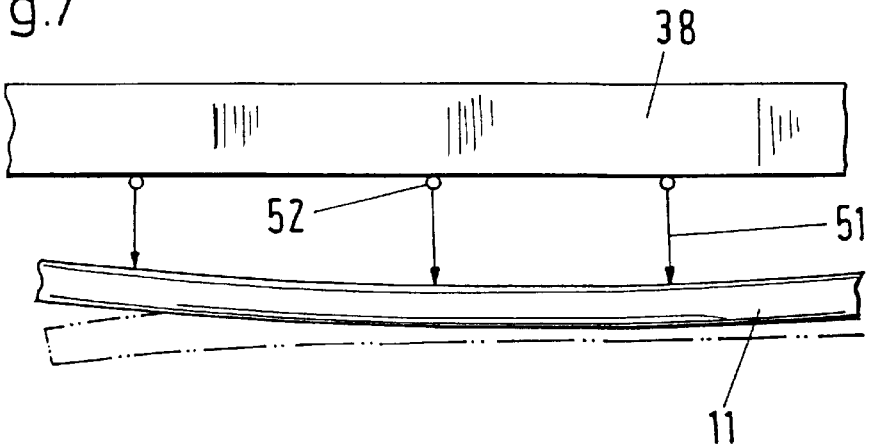
FIG. 7 is a schematic illustration of the method of operation of the present apparatus.

With reference to FIGS. 5 to 7, FIG. 5 shows a warp tensioner 4 provided with a tensioner beam 11 which is displaceably arranged on the machine frame 17 of a weaving machine. The elements required for the guidance of the warp tensioner are not shown. As is further shown in FIG. 5, an air spring 51 is connected at the one end to the warp tensioner and at the other end to the support 38 by means of a joint arrangement 52. The air spring 51 is connected via the connection line 25 to the control system not illustrated here. The tensioner beam 11 is supported on a plurality of warp tensioners 4 which are arranged at freely selectable spacings, which can be the same or different. The joint arrangement 52 is executed in such a manner that the air spring 51 can be pivoted about a vertical axis 53. As shown in FIG. 7, the tensioner beam 11 can be deformed in its longitudinal extent and the thread tensions acting on the warp threads can be held substantially at the same level.

Figure 8:
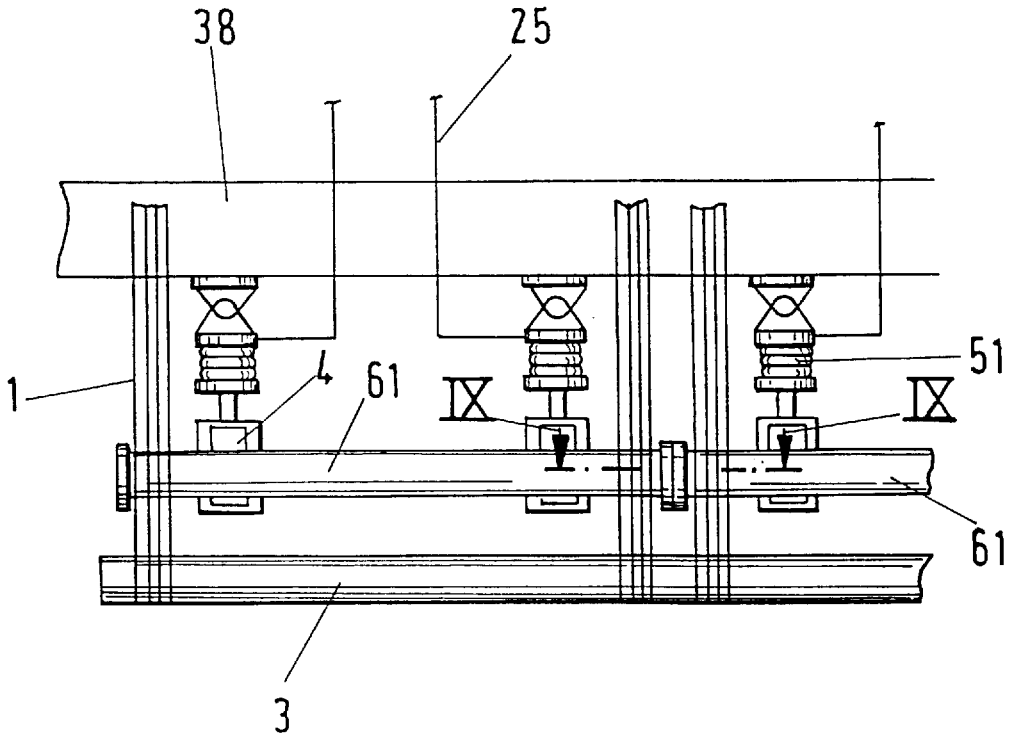
FIG. 8 is a modification of the apparatus in accordance with FIG. 5.
Figure 9:
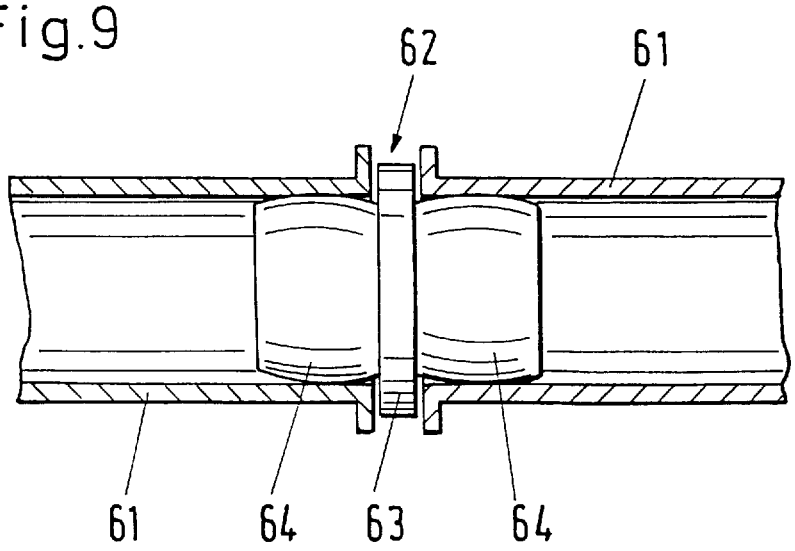
FIG. 9 is a section along the line IX—IX in FIG. 8.

With reference to FIGS. 8 and 9, a number of tensioner beam elements 61 are provided in place of the single piece tensioner beam 11 of FIG. 6. At least one warp tensioner 4, one air spring 51 and one control system of the previously described kind is associated with each of these tensioner beam elements 61. It is possible to substantially reproduce the deformation illustrated in FIG. 7 by means of the tensioner beam elements 61. In order to achieve a continuous tension surface for the array of warp threads, connection members 62 are provided in each case at the interfaces between the tensioner beam elements 61. The connection members have a central section 63 and two insertion sections 64 with ball-like outer surfaces.

Figure 10:
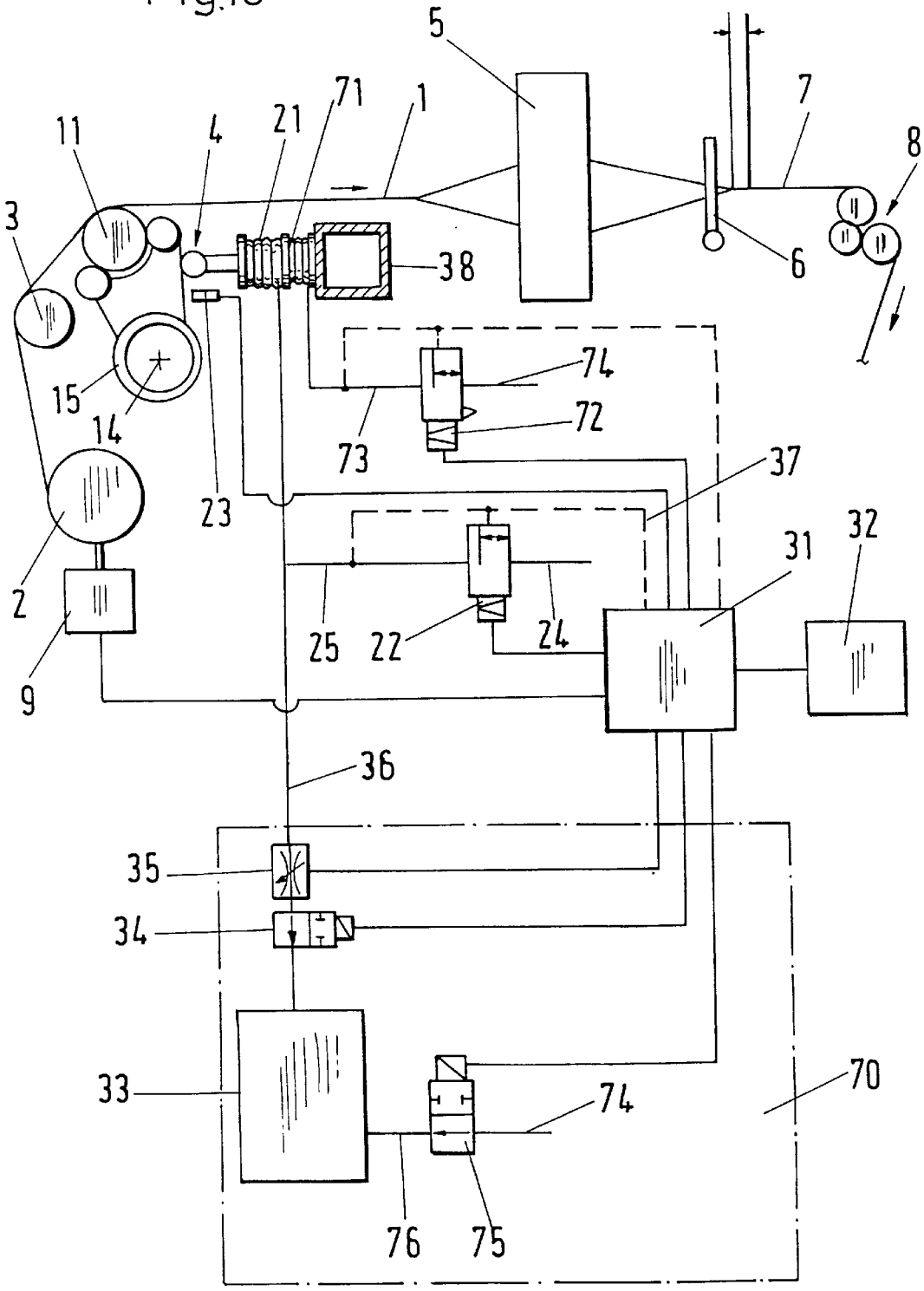
FIG. 10 is a schematic illustration of a fourth embodiment of an apparatus in accordance with the invention.

FIG. 10 shows an apparatus which is hydropneumatically actuated in order to set the position of the warp tensioner 4. In this apparatus an additional setting element 71 and an electrically actuated control valve 72 are provided in addition to the air spring 21 with the control circuit for the pressure regulation and the control circuit for the volume change. The additional setting element 71 is e.g. a bellows, which is connected at one end to the air spring 21 and is braced or secured at the other end at the support 38. The electrically actuatable control valve 72 is connected, on the one hand, via a line 73 to the setting element 71 and, on the other hand, via a line 74 to a hydraulic source (not shown) are provided. In order to vary the volume in the container 33, a 2/2-way valve 75 is provided in this apparatus which is connected at the one end via the line 74 to the hydraulic source and at the other end to the container 33. The control valve 72 and the 2/2-way valve 75 are connected in a signal transmitting manner to the weaving machine control unit 31.

Figure 11:
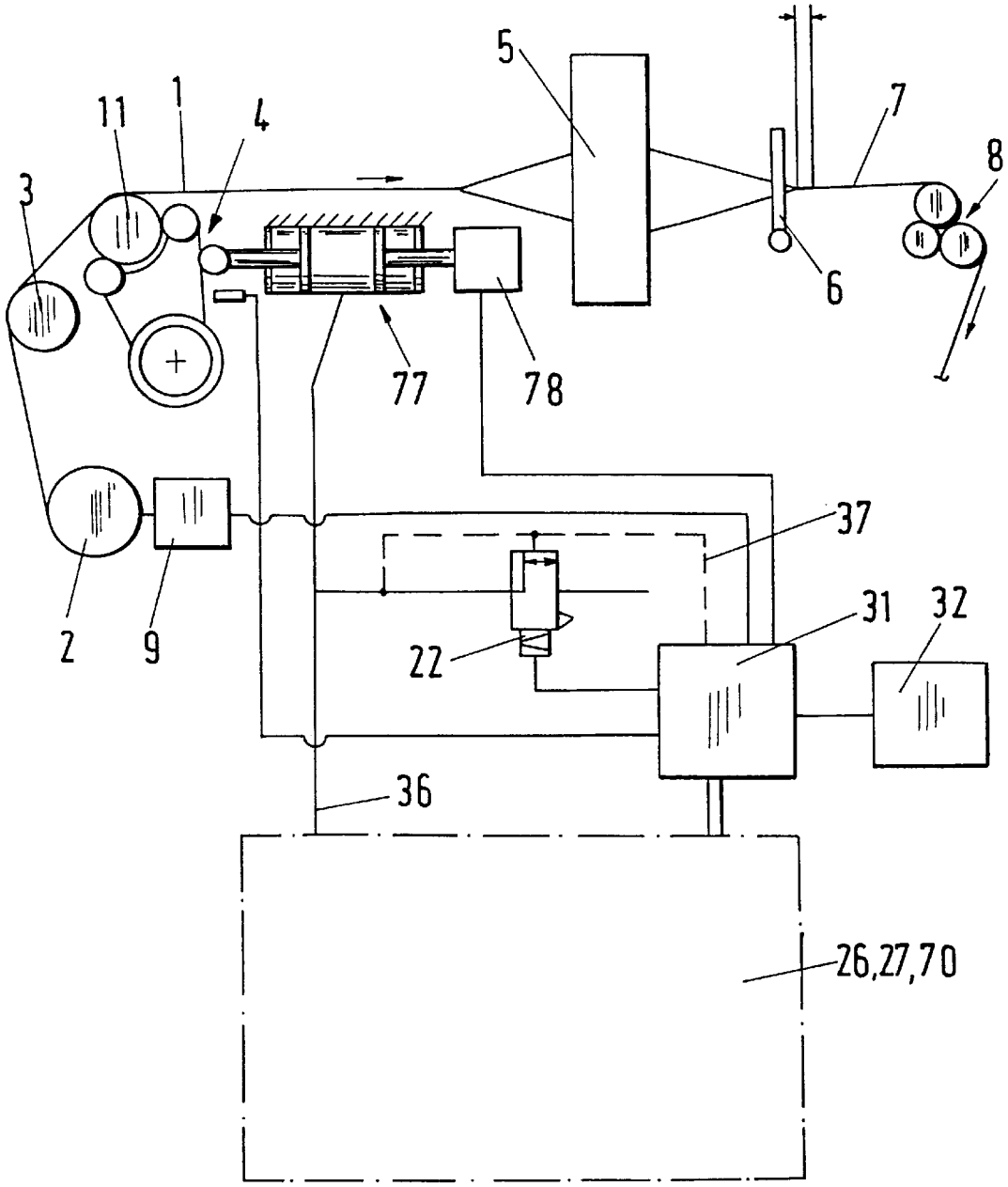
FIG. 11 is a schematic illustration of a fifth embodiment of an apparatus in accordance with the present invention.

FIG. 11 shows an apparatus which is actuated pneumatically and mechanically in order to vary the position of the warp tensioner 4. For this, a piston arrangement 77 with a drive 78 is provided which is connected to the weaving machine control unit 31 in a signal transmitting manner in order to control the arrangement 77 from the terminal 32.

It remains to be added that the tensioner beams 11, 61 are executed in tubular shape and are advantageously provided with a filler material (not shown) in order to prevent bending of the tubes. The tubes can consist of a metal or of a non-metal.

The apparatus contains a spring member 21 which is in working connection with the warp tensioner 4 and a control system which has a container 33 communicating via a 2/2-way valve 34 with the spring member 21, 51 in order to vary the spring stiffness of the spring member and the position of the warp tensioner from a terminal at the side where the weaver stands by means of increasing and reducing the volume of the air spring.

We claim:

1. Apparatus for the control of a warp tensioner comprising:

a spring member, which contains a fluid, for connection to the warp tensioner;

a control system that contains a sensor for sensing the position of the warp tensioner; and a control valve for varying the spring force of the spring member by increasing and decreasing pressure thereby adjusting the tensioner beam, the control system including a plurality of containers and shut-off members that are connected in either series or in parallel, the containers communicating with the spring member via the shut-off members thereby varying spring stiffness of the spring member by increasing and decreasing the effective volume of the spring member to thereby restrict the pivotal range of the warp tensioner.

2. Apparatus in accordance with claim 1 wherein a restrictor is associated with each container.

3. Apparatus in accordance with claim 2 wherein the control valve, each shut-off member and the restrictor are connected in a signal transmitting manner to at least one of the control system and a terminal.

4. Apparatus in accordance with claim 1 wherein a device is connected to the spring member for varying the pressure in the spring member.

5. Apparatus in accordance with claim 4 wherein a second spring member is connected in a communicating manner to the spring member.

6. Apparatus in accordance with claim 5 further comprising means for actuating the second spring member.

7. Apparatus in accordance with claim 1 wherein the control valve is a setting member of a regulating circuit for controlling the control valve by sensing a change of pressure in the spring member.

8. Apparatus in accordance with claim 1 further comprising a hydraulically actuatable setting element that is connected to the spring member, and an electronically actuatable valve for actuating the setting element, wherein the setting element communicates with the electronically actuatable valve via a line for varying the position of the warp tensioner.

9. Apparatus in accordance with claim 1 further comprising valves that communicate with the containers via lines for varying the effective volume of the containers through hydraulic fluid.

10. Apparatus in accordance with claim 1 further comprising a piston arrangement having a drive for active connection with the warp tensioner for varying the position of the warp tensioner.

11. A warp tensioner including a tensioner beam and an apparatus for controlling the warp tensioner, the apparatus comprising:

a spring member, which contains a fluid, for connection to the warp tensioner;

a control system that contains a sensor for sensing the position of the warp tensioner; and a control valve for varying the spring force of the spring member by increasing and decreasing pressure thereby adjusting the tensioner beam, the control system including a plurality of containers and shut-off members that are connected in either series or in parallel, the containers communicating with the spring member via the shut-off members thereby varying spring stiffness of the spring member due to increasing and decreasing the effective volume to thereby restrict the pivotal range of the warp tensioner;

wherein the spring member is associated with the tensioner beam.

12. The warp tensioner of claim 11 wherein the tensioner beam is a one-piece design.

13. The warp tensioner of claim 11 wherein the tensioner beam consists of a plurality of elements and the spring member is associated with each tensioner beam element.

14. A warp tensioner in accordance with claim 11 wherein the tensioner beam is of tubular design.

15. A warp tensioner in accordance with claim 14 wherein the tensioner beam consists of metal.

16. A warp tensioner in accordance with claim 14 wherein the tensioner beam consists of a non-metal.

17. A weaving machine including a warp tensioner and an apparatus for controlling the warp tensioner, the apparatus comprising:

a spring member, which contains a fluid, for connection to the warp tensioner;

a control system that contains a sensor for sensing the position of the warp tensioner; and a control valve for varying the spring force of the spring member by increasing and decreasing pressure thereby adjusting the tensioner beam, the control system including a plurality of containers and shut-off members that are connected in either series or in parallel, the containers communicating with the spring member via the shut-off members thereby varying spring stiffness of the spring member due to increasing and decreasing the effective volume to thereby restrict the pivotal range of the warp tensioner.

* * * * *